United States Patent [19]

Mayo

[11] 4,290,409

[45] Sep. 22, 1981

[54] FIREPLACE GLASS DOOR WITH HEAT CIRCULATOR

[75] Inventor: Carlos Mayo, Springdale, Ark.

[73] Assignee: C. Mayo, Inc., Springdale, Ark.

[21] Appl. No.: 84,080

[22] Filed: Oct. 12, 1979

[51] Int. Cl.[3] ..... F24B 7/00

[52] U.S. Cl. ..... 126/121; 126/140; 126/198; 126/202; 160/DIG. 9

[58] Field of Search ..... 126/121, 140, 138, 198, 126/202; 165/172; 237/51; D23/94; 110/180; 160/DIG. 9

[56] References Cited

U.S. PATENT DOCUMENTS

| | | | |
|---|---|---|---|
| 2,398,240 | 4/1946 | Merryweather et al. | 126/140 |
| 3,368,545 | 2/1968 | Ibbitson | 126/140 X |
| 4,084,571 | 4/1978 | McFarland | 126/198 |

FOREIGN PATENT DOCUMENTS

| | | | |
|---|---|---|---|
| 691340 | 10/1930 | France | 126/140 |
| 1344299 | 10/1963 | France | 126/121 |
| 197465 | 5/1923 | United Kingdom . | |
| 808053 | 1/1959 | United Kingdom . | |
| 2013872 | 8/1979 | United Kingdom | 126/198 |

*Primary Examiner*—Samuel Scott
*Assistant Examiner*—Randall L. Green
*Attorney, Agent, or Firm*—Robert R. Keegan

[57] ABSTRACT

There is disclosed a fireplace screen comprising a frame which fits against the fireplace opening and a pair of doors hinged at the side which substantially close the fireplace opening and are fitted with glass panes so that the interior of the fireplace is visible from the adjacent room. The fireplace doors are of substantial thickness and are provided with vertical tubes inside the glass panes which have openings at the top and the bottom of the door to permit the passage of air from the room through the tubes and back into the room again. The tubes are preferably black to make them beat absorbing at least on the side facing the fireplace with the result that the tubes become quite hot and the air passing through the tubes is significantly heated. Heating of the air causes a chimney effect so that the air is drawn in at the bottom of the tube heated and exhausted at the top of the tube. The diameter of the tubes is preferably smaller than the spacing of the tubes so that a substantial area of the glass panes is left unobstructed and the fire in the fireplace is readily visible. The bottoms of the doors with the lower tube openings therein are spaced substantially above the bottom of the frame of the fire screen so that when the frame rests on the hearth of the fireplace there is a substantial space between the bottom of the tubes and the hearth of the fireplace for the passage of air from the room into the heat circulating tubes.

8 Claims, 3 Drawing Figures

FIREPLACE GLASS DOOR WITH HEAT CIRCULATOR

The present invention relates to a screen for a wood burning fireplace with glass doors which have built into them a heat circulating arrangement so that air from the room passes through tubes to be heated and is passed back into the room. At the same time the fire screen is preferrably of the sort that effectively seals off the fireplace opening from the adjacent room so that air is not drawn into the fireplace for combustion and exhausted up the chimney, the combustion air being rather provided by an outside air vent.

Heat circulating wood burning fireplace structures are of course well-known, but these normally require substantial additional apparatus either built into the fireplace or added to the fireplace apparatus, whereas the present invention provides a glass door fire screen having the heat circulating arrangement built into it with little added structure or expense.

There are other heat circulator arrangements which cause air to be drawn into tubes within the fireplace and then ejected into the room; they are so constructed that it is impossible to operate them with the fireplace opening closed off by glass doors or the like. In particular prior art devices do not provide highly effective heat exchange and heat circulating tubes entirely within the fireplace door and arranged so that there is minimum obstruction of the view through the glass doors of the fireplace, and no added equipment inside the fireplace. For example, U.S. Pat. No. 3,368,545 to Ibbitson, discloses apparatus wherein there are air heating tubes associated with fireplace doors without obtaining the specific advantages of the invention described above. There are other prior devices and patents which disclose heat circulating apparatus for fireplaces but which are not directed to the purpose nor adapted to provide the advantages of the present invention; representative of these devices are U.S. Pat. Nos. 1,377,108 to Williams; 2,549,365 to Borge; 2,707,946 to Merriweather, et al; 2,747,568 to Dupler; 3,459,173 to Lydle; 4,029,076 to Simington; 4,091,793 to Stites; and 4,129,113 to Bergstrom.

In addition to providing the features and advantages described above it is an object of the present invention to provide a transparent fireplace screen with provision for circulating the air of the room adjacent the fireplace and heating it from the radiant and/or convected heat of the fireplace.

It is another object of the present invention to provide a fireplace screen with glass doors having incorporated therein tubes which intercept a portion of the radiant heat of the fireplace while providing minimal obstruction of the view through the glass doors of the screen and in which the heat of the fireplace is transferred to air circulating through such tubes.

It is still another object of the present invention to provide a fireplace screen which substantially seals the fireplace opening against transfer of air from the adjacent room into the fireplace and up the chimney and at the same time provides heat exchange tubes in the door of the fireplace which open into the adjacent room and cause the heat of the fireplace to be circulated by convection in the adjacent room.

Other objects and advantages of the invention will be apparent from consideration of the following description in conjunction with the appended drawings in which.

Figure 1:
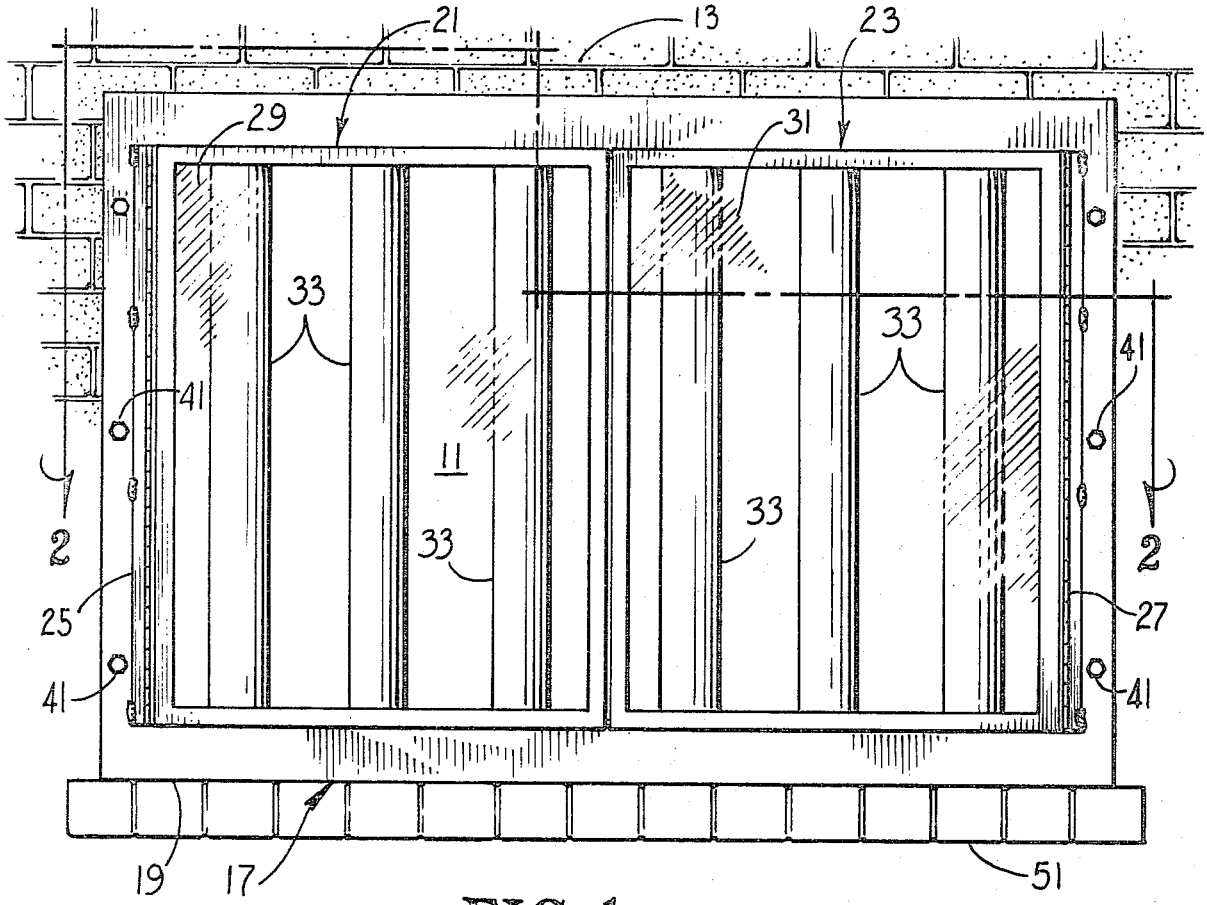
FIG. 1 is a front elevational view of the fireplace screen with heat circulator according to the invention.

Referring now to the drawings, a wood burning fireplace 11 is shown with a face 13 against which is secured a screen 17 comprising a frame 19 having doors 21 and 23 mounted thereon by means of hinges 25 and 27. The bottom of frame 19 is even with the floor 15 of the fireplace while the side and top edges of frame 19 slightly overlap the opening in the face 13 of fireplace 11. The amount of overlap of frame 19 is not critical so that a screen 17 of a particular size may be used with fireplace openings over a substantial range of sizes. It is contemplated, of course, that screens of a variety of sizes would be available but the number of such varieties would not need to be great.

In the front of doors 21 and 23 are mounted glass panes 29 and 31 retained in place by suitable fixtures such as brackets 30. Doors 21 and 23 are of substantial thickness from several inches up to half a foot.

Open tubes 33 are mounted vertically within doors 21 and 23 so that they communicate with openings 39 in the top panel 35 and the bottom panel 36 of each of the doors 21 and 23. Screen 17 may be secured in any suitable fashion to the face 13 of fireplace 11 as by lag bolts 41 passing through holes (not shown) in frame 19 and into the face 13 of fireplace 11. Where the fireplace is of brick as shown by way of illustration in the drawings a hole would normally be drilled in the brick and a soft plug inserted to accept the threaded ends of bolts 41.

Doors 21 and 23 are preferably provided with a vertically elongated flange 45 and a seal strip 43 to provide a more nearly airtight closure where doors 21 and 23 join. For the same purpose an extension 40 may be provided on the top panel 35 and bottom panel 36 of door 21 which overlaps corresponding panels on door 23 and restricts air flow into the fireplace between the two doors. It will be seen that the illustrated embodiment of the screen in the drawings accordingly provides an intentionally tight seal to restrict air flow to or from the fireplace opening. This contemplates that the fireplace will be provided with combustion air from an outside air vent. Providing outside combustion air is, of course, highly desirable since it prevents cold replacement air being drawn into the house structure to replace the air drawn into the fireplace and ejected up the chimney. Modifications of the particular screen 17 illustrated could, if desired, be provided with openings in the bottom of frame 19 or elsewhere for entry of combustion air into the fireplace and such openings could be arranged to be partially or entirely closed.

The fireplace 11 is provided with a hearth 51 which is an extension of and on the same level with the floor 15 of the fireplace. Thus the bottom of frame 19 being even with the floor 15 rests on hearth 51. In some cases the hearth may be below the level of floor 15 and then frame 19 may either rest on hearth 51 or be spaced above it (but no higher than the floor 15 of fireplace 11 so that the fireplace opening is closed). The construction of the screen 17 is such that a space is provided between the openings 39 in panels 36 and the top surface of hearth 51 so that there will be an unrestricted space for flow of air into tubes 33.

The installation of the fire screen 17 is straightforward and similar to any other glass door fire screen. As with ordinary glass door fire screens it is possible to employ a metal link flexible screen in addition to the glass doors within the fireplace opening to protect against sparks and embers when the doors are open. This is, however, practically unnecessary since the advantage of heat as well as visibility is provided by the screen when the doors are closed.

Figure 2:
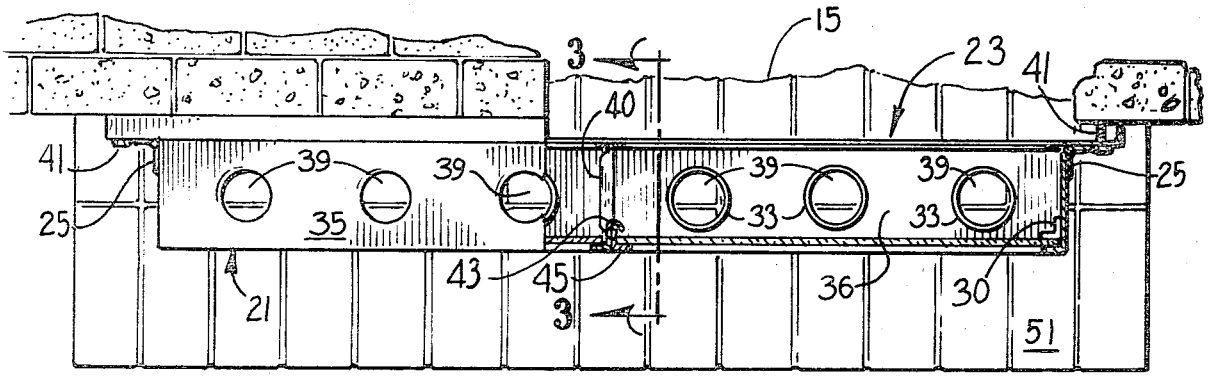
FIG. 2 is a sectional view taken along the broken line 2—2 in FIG. 1.
Figure 3:
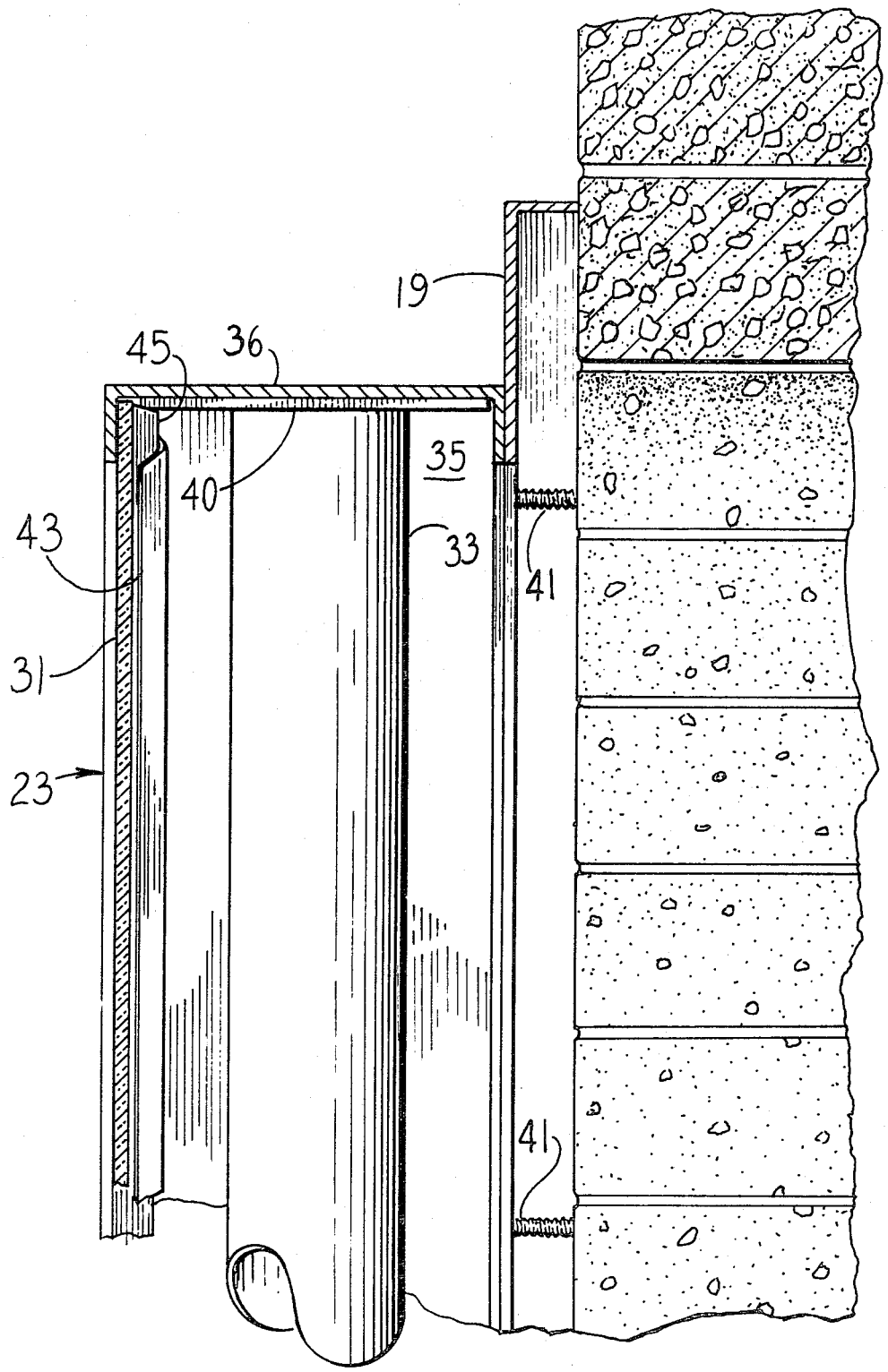
FIG. 3 is a vertical sectional view taken along the line 3—3 in FIG. 2.

The doors 21 and 23 open through an angle of approximately 90 degrees and when open leave the opening in frame 19 substantially unobstructed for tending the fire, adding fuel to the fire, etc. As previously mentioned the tubes 33 are preferably black, at least on the surface facing the fireplace interior, to maximize absorption of radiant heat. Heat passes through the walls to the interior of tubes 33 by conduction. All portions of the screen 17 except for glass panes 29 and 31 may be formed of sheet metal such as steel and fabricated by welding or use of fasteners such as bolts or rivets or any combination thereof. The screen 17 may also be formed of other sheet metal such as brass or aluminum and there may be some advantage in utilizing the higher heat conductivity of aluminum in tubes 33 to improve heat transfer to the air moved by convection through tubes 33. Other known means to improve the heat transfer such as baffles within tubes 33 may be employed but the operation of the apparatus is highly satisfactory with the simple and inexpensive construction of the embodiment illustrated in FIGS. 1, 2, and 3.

If there were any necessity for arranging the doors 21 and 23 so that they could be folded flat against the face 13 of fireplace 11, this may be accomplished by the simple expedient of using a double hinge arrangement of conventional form in place of the simple hinges 25. In fact the manner in which the doors are opened is irrelevant to the invention and they could even be arranged to slide to one side rather than being swung on hinges. Whatever the door arrangement it will be recognized that a single door may be used, two doors may be used, or a multiple panel hinged door arrangement may be employed.

The invention is also subject to variation in regard to the number and placement of tubes 33. More or less tubes than three might be placed in each door. Also the outermost of the tubes 33 may be arranged to be at the edge of the door rather than spaced from the edge as shown in FIG. 1. It may be noted that the tubes 33 are rigid structural members and by being firmly secured by welding or the like to panels 35 and 36 they contribute substantially to the structural strength of doors 21 and 23.

Tubes 33 are shown to be circular but there is no necessity that they take this shape. They could, for example, be rectangular or oval in cross-section. Oval tubes might be placed with the long diameter running frontward and backward so as to reduce the obstruction of view of the fireplace interior while maintaining large cross-sectional area for the tubes. Each tube 33 may be replaced by two or more smaller diameter tubes one behind the other if desired.

The fire screen according to the present invention may be used by itself in a conventional fireplace without other heat circulating means or it may be used in conjunction with other heat circulating means built into the fireplace. As previously mentioned it is preferable that outside combustion air be provided so that the fire screen 17 may completely close off the fireplace but a simple modification to the illustrated embodiment may provide combustion air from the adjacent room if necessary. Fire screens according to the invention are not limited to fireplaces with conventional openings as illustrated in the drawings but may also be adapted to corner fireplaces and other odd shaped openings merely by adapting the shape of the frame 19 and the mounting of the doors 21 and 23 to the particular fireplace opening shape. In rare cases it may be desired to render the heat circulating tubes 33 ineffective to prevent unwanted heating of the room adjacent to the fireplace. This may readily be accomplished by providing metal caps fitting into the openings 39 in panels 35. In this manner any or all of the heating tubes 33 may be rendered substantially ineffective.

From the foregoing description and explanation it will be seen that a fireplace screen is provided according to the present invention which has the advantages of a glass door fireplace screen of conventional construction and with little additional complexity or expense is provided with heat circulating apparatus which very effectively transfers heat from the fire to the air of the adjacent room which would otherwise be retained within the fireplace firebox and wasted with the exhausting flue gases. Heat transfer both by radiation and convection to the tubes 33 is in very large measure transferred to the air circulating through tubes whereas little radiant heat passes through glass panes 29 and 31 and even though panes 29 and 31 may become rather hot, this heat likewise is not efficiently transmitted to the adjacent room either by radiation or by convection.

In addition to the variations mnd modifications to the invention which have been described or suggested above, other modifications and variations will be apparent to those skilled in the art and accordingly the scope of the invention is not to be deemed to be limited to the embodiment illustrated or the variations or modifications suggested but is to be determined by reference to the appended claims.

What is claimed is:

1. A fireplace screen comprising a frame with a central opening adapted to be attached to a fireplace, at least one door having a top and a bottom and supported by and extending outwardly from said frame and movable to cover and uncover said opening, said door having a thickness of at least one inch from its inner side to its outer side and a transparent glass pane mounted therein spaced from the inner side of said door, at least two elongated tubular air ducts open at both ends, spaced apart from each other, extending vertically in said door, located toward the inner side of said door from said glass pane, and each having a wall which absorbs radiant heat from the fireplace causing heating of air in said duct, said door having openings communicating with said open duct ends.

2. Apparatus as recited in claim 1 wherein each said duct is a hollow metal cylinder.

3. Apparatus as recited in claim 1 wherein said door is hinged at one vertical edge to said frame.

4. Apparatus as recited in claim 1 wherein there are two doors and one of said doors has a seal strip engaging the other of said doors to impede air flow into said fireplace opening at the junction of said doors when closed.

5. A fireplace screen for a woodburning fireplace opening comprising an open frame adapted to be fastened to the face of a fireplace and surround the opening thereof, a pair of doors, hingedly attached to the sides of said frame, extending outwardly therefrom and adapted to close against said frame and each other to substantially close the opening of said fireplace, each said door being in the form of a box of substantial thickness with top, bottom, first vertical, and second vertical panels with a vertical rectangular glass pane with its four edges meeting the respective ones of said panels near their outer edges, a plurality of spaced apart tubular air ducts in said doors located toward the inner side of said door from said glass pane, each being open at both ends and extending from an opening in one of said bottom panels to an opening in one of said top panels, said bottom panels being spaced upward from the bottom of said frame.

6. Apparatus as recited in claim 5 wherein each said duct is a hollow metal cylinder.

7. Apparatus as recited in claim 5 wherein each said door is hinged at one vertical edge to said frame.

8. The apparatus as recited in claim 5 wherein each said duct has a horizontal cross-section, the greatest dimension of which is not greater than the thickness of said box forming said door.

* * * * *